US010640322B2

(12) United States Patent
Faler

(10) Patent No.: US 10,640,322 B2
(45) Date of Patent: May 5, 2020

(54) APPARATUS AND METHOD FOR REDUCING WHIP DAMAGE ON WOUND OPTICAL FIBER

(71) Applicant: Corning Incorporated, Corning, NY (US)

(72) Inventor: Bret Cooper Faler, Wilmington, NC (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 16/125,959

(22) Filed: Sep. 10, 2018

(65) Prior Publication Data

US 2019/0100402 A1 Apr. 4, 2019

Related U.S. Application Data

(60) Provisional application No. 62/565,688, filed on Sep. 29, 2017.

(30) Foreign Application Priority Data

Oct. 27, 2017 (NL) ..... 2019818

(51) Int. Cl.
*B65H 57/04* (2006.01)
*B65H 63/024* (2006.01)
(Continued)

(52) U.S. Cl.
CPC ..... *B65H 57/04* (2013.01); *B65H 54/72* (2013.01); *B65H 57/003* (2013.01); *B65H 63/024* (2013.01); *B65H 2701/32* (2013.01)

(58) Field of Classification Search
CPC ..... B65H 57/003; B65H 57/04; B65H 57/22; B65H 63/024; B65H 54/72; B65H 2701/32
See application file for complete search history.

(56) References Cited

U.S. PATENT DOCUMENTS 3,952,960 A 4/1976 Veyrassat
5,558,287 A 9/1996 Darsey et al.
(Continued)

FOREIGN PATENT DOCUMENTS

EP 887298 A1 12/1998
JP 2907381 B2 6/1999

OTHER PUBLICATIONS

Dutch Patent Application No. 2019818 Search Report dated July 19, 2018; 9 Pages; European Patent Office.
(Continued)

*Primary Examiner* — William E Dondero
(74) *Attorney, Agent, or Firm* — Kevin L. Bray

(57) ABSTRACT

An apparatus for reducing fiber whip damage to optical fiber wound on a fiber winding spool is provided. The apparatus includes a fiber entry feed mechanism operatively coupled to the fiber winding spool to feed the optical fiber onto the fiber winding spool. The apparatus also includes a whip shield arranged to substantially surround the fiber winding spool. The whip shield includes a first surface aligned with and facing the fiber winding spool within an entry slot that is laterally offset from a second surface. The first surface transitions to the second surface such that a loose end of the optical fiber is initially directed into the entry slot away from the fiber winding spool and transitions to the second surface.

15 Claims, 7 Drawing Sheets

(51) Int. Cl.
*B65H 57/00* (2006.01)
*B65H 54/72* (2006.01)

(56) References Cited

U.S. PATENT DOCUMENTS

| | | | |
|---|---|---|---|
| 5,964,431 | A | 10/1999 | Chang et al. |
| 6,152,399 | A | 11/2000 | Chang et al. |
| 6,299,097 | B1 | 10/2001 | Bird et al. |

OTHER PUBLICATIONS

Harri Turunen; "Mechanical Reliability of Optical Fiber in Combined Continuous Draw and Proof Testing Process,"; Helsiniki University of Technology Publications in Machine Design, Mar. 2005; 146 Pages.

APPARATUS AND METHOD FOR REDUCING WHIP DAMAGE ON WOUND OPTICAL FIBER

This application claims the benefit of priority to Dutch Patent Application No. 2019818, filed on Oct. 27, 2017, which claims the benefit of priority under 35 U.S.C. § 119 of U.S. Provisional Application Ser. No. 62/565,688 filed on Sep. 29, 2017 the content of which is relied upon and incorporated herein by reference in its entirety.

FIELD OF THE DISCLOSURE

The present invention is generally directed to a fiber entry whip reduction apparatus and a method for preventing damage to fiber, such as an optical fiber, being wound onto a rotating spool caused by the whipping action of a loose end of the fiber acting on the fiber already wound on the spool.

BACKGROUND OF THE DISCLOSURE

In the optical fiber manufacturing industries, long lengths of fiber are wound at high speeds upon machine rotated take-up spools for shipping and handling. As the fiber is wound on the spool, the fiber is laid down onto the spool in successive layers. In the optical fiber industry, fiber winding typically occurs at the draw tower where the fiber is originally drawn, and at an off-line screening station where the fiber is strength tested. At each of these locations, the fiber can be wound at high speeds, for example, over 20 meters per second and higher, and is maintained at relatively high tension. The apparatus for winding the fiber may include a feed assembly that includes several pulleys which guide the fiber. The pulleys facilitate proper tension on the fiber as it is wound onto the spool, while the feed apparatus facilitates uniform fiber winding onto the spool.

During winding, the fiber is susceptible to breakage due to forces applied by the winding machine. When fiber breaks occur during winding, the loose end of the fiber tends to whip around at high speed due to the rapid rotation rate of the take-up spool. The uncontrolled loose end of the fiber can impact fiber already wound onto the spool and cause significant damage to many layers of the fiber. The break event may be unpredictable, and following such a break the rotation of the spool must be brought to an immediate stop to prevent whipping damage to the fiber. However, because the break is unpredictable and the spool cannot be stopped instantaneously, there is inevitably a period of time during which the spool will continue to rotate and the fiber end will be drawn toward the spool where it can whip relatively uncontrolled against the fiber already wound onto the spool, thus causing damage to the fiber.

In order to prevent fiber whip damage to the fiber already wound on the spool, techniques have been developed in an attempt to prevent the loose end of the fiber from striking fiber already wound on the spool. In most cases, manufacturers use guards or shields mounted for safety reasons. Despite the presence of guards, the loose end of the optical fiber is still susceptible to damage caused by contact with the guard, gaps near the guard and with the wound fiber. In addition, the tail of the fiber may break into shards which may cause more damage to the fiber. Accordingly, it is desirable to provide for an enhanced apparatus and method for reducing fiber whip damage to optical fiber wound on a fiber winding spool.

SUMMARY OF THE DISCLOSURE

According to one embodiment, the present disclosure is directed to a novel apparatus and method for reducing or preventing fiber entry whip of an optical fiber being wound on a spool by overcoming one or more of the above-described shortcomings associated with fiber winding. "Optical Fiber," as used herein, includes both glass and plastic optical fiber.

A principal advantage of the present disclosure is the provision of an arrangement which substantially obviates one or more of the limitations and shortcomings associated with arrangements known in the art. By maintaining the free end of the fiber against an entry groove within the whip shield, the fiber is directed away from the wound fiber and is able to enter the smooth continuous inner surface of the shield in a manner that minimizes damage to the fiber.

According to one embodiment, an apparatus for reducing fiber whip damage to optical fiber wound on a fiber winding spool is provided. The apparatus includes a whip shield arranged to substantially surround the fiber winding spool, the whip shield comprising a first surface aligned with and facing the fiber winding spool within an entry slot aligned with the fiber fed from a moving source of fiber such that a loose end of the optical fiber during a fiber break event is directed into the entry slot away from the fiber winding spool and against the first surface. The whip shield comprising a second surface facing the spool, wherein the first surface of the entry slot transitions to the second surface so that the loose end of the optical fiber is transitioned from the first surface onto the second surface.

According to another embodiment, a method for reducing fiber whip damage to fiber wound on a fiber winding spool. The method includes the steps of feeding optical fiber from an optical fiber source onto the fiber winding spool, directing a loose end of the fiber into an entry slot formed having an inner first surface in a whip shield, and redirecting the loose end of the fiber from the entry slot to a smooth continuous second surface on the inside surface of the whip shield.

DETAILED DESCRIPTION

Figure 1:
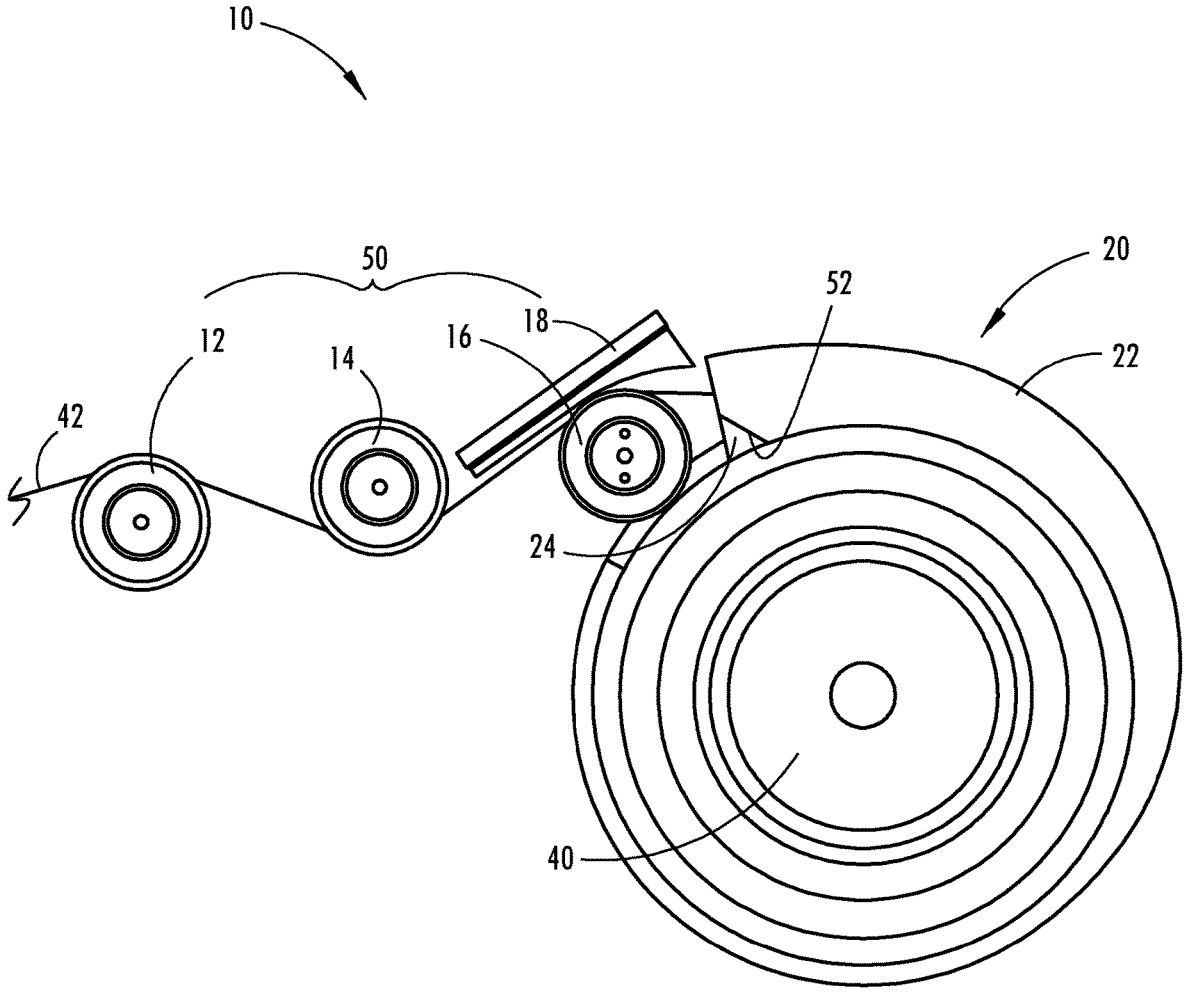
FIG. 1 is a side elevation view of a fiber entry whip reduction apparatus, according to one embodiment.

Reference will now be made in detail to the present preferred embodiments of the invention, examples of which are illustrated in the accompanying drawings. Whenever possible, the same reference numbers will be used throughout the drawings to refer to the same or like parts. A preferred embodiment of the fiber entry whip reduction apparatus is shown in FIGS. 1-10, and is designated generally throughout by reference numeral 10.

Figure 2:
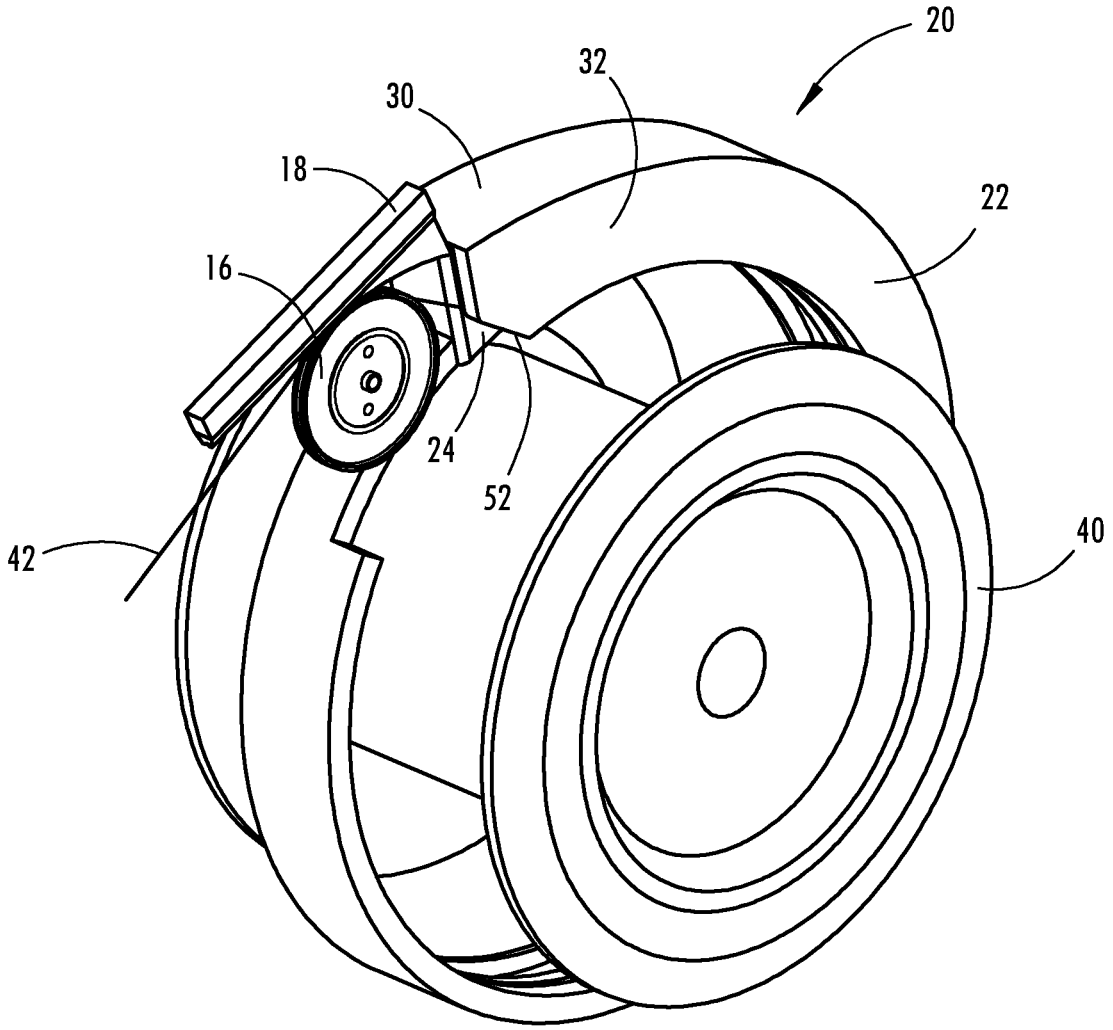
FIG. 2 is a perspective view of the fiber winding device of the fiber entry whip reduction apparatus shown in FIG. 1.

FIGS. 1 and 2 illustrate a fiber entry whip reduction apparatus 10 in accordance with one embodiment for reducing fiber entry whip caused by a loose tail end of the fiber such as during the manufacture and winding storage of fiber, such as optical fiber used in telecommunication applications. The fiber entry whip reduction apparatus 10 includes a fiber winding device 20 having a whip shield 22 substantially surrounding a fiber winding spool 40 on which fiber 42 is wound during the winding process. The fiber winding spool 40 is rotated by a motor (not shown) which applies tension to the fiber 42 and winds the fiber 42 onto the spool with multiple overlapping layers of fiber.

The fiber 42 may enter the fiber winding device 20 through a fiber entry feed mechanism 50 shown in one embodiment as an arrangement of pulleys. In the illustrated embodiment, the pulley arrangement includes a feed pulley 14 that guides the fiber 42 into a fiber entry whip reducer 18. The pulley arrangement may optionally include, but is not limited to an entrance pulley 12 that receives the fiber from a fiber source and helps guide and maintain tension on the fiber 42. An exit pulley 16 redirects the fiber 42 from the feed pulley 14 to the spool 40.

Fiber 42 may be wound onto the fiber winding spool 40 at a relatively high rate of speed, e.g., draw speeds of about 30, 40, 50, 60, 70 m/s or potentially even higher. Fiber 42 is also maintained at a sufficiently high tension to ensure proper winding onto the fiber winding spool 40. If the fiber 42 is an optical fiber, it may be supplied directly from any known type drawing apparatus (not shown) or a known type of optical fiber tensile or other screening device (not shown) or other fiber source.

Ideally, if the fiber winding spool 40 was suspended in free space, there would be no need for any shield or guard around the spool 40. However, as illustrated in FIGS. 1 and 2, in order to contain the fiber 42, to prevent damage to the fiber already wound on spool 40, as well as to prevent injuries to operators standing near the spool 40 if the fiber 42 breaks, a whip shield 22 is mounted around the fiber winding spool 40. In practice, if the fiber 42 breaks, the loose end of the fiber being wound onto the spool 40 at a high speed will be maintained against the inner surface of the whip shield 22 due to centrifugal force and forward motion of the fiber. However, the entrance to the fiber winding device 20 in a conventional arrangement presents an obstacle as the whip shield 22 creates several edges on which the fiber can catch. If left unaddressed, any edge of the whip shield 22 could cause the fiber end or tail to wrap itself around the edge and whip back on the wound fiber 42 on the spool 40 as the loose end of the fiber enters the spool area.

The version of fiber entry whip reduction apparatus 10 illustrated includes a fiber entry feed mechanism 50 shown having the exit pulley 16 for receiving fiber 42 wound upon entrance pulley 12 and feed pulley 14. Thus, during the fiber winding operation, the exit pulley 16 redirects the fiber 42 onto the fiber winding spool 40. The fiber entry feed mechanism 50 feeds the fiber 42 from a fiber source onto the fiber winding spool 40. The entry whip reducer 18 is an optional device that may be employed which is positioned over the exit pulley 16 to guide the fiber tail (during a fiber break event) onto the interior surface of the whip shield 22 and reduce whip action of the fiber 42 during a break as the fiber tail passes from the feed pulley 14 and over the exit pulley 16. The entry whip reducer 18 may or may not be included. In one embodiment, the entry whip reducer 18 may include one or more guide channels for guiding the fiber 42 onto an interior surface of the fiber whip guard and for reducing or controlling the whipping action of the fiber 42 when it breaks or is cut during fiber winding.

In the embodiment illustrated, fiber entry feed mechanism 50 may be operatively coupled to the fiber winding spool 40 to feed the optical fiber 42 onto the fiber winding spool 40. The fiber entry feed mechanism 50 may include the exit pulley 16 as well as the entrance pulley 12 and feed pulley 14, according to one embodiment. It should be appreciated that other feed mechanisms for feeding the optical fiber 42 onto the fiber winding spool 40 may be employed, according to other embodiments.

The fiber entry whip reduction apparatus 10 further includes a whip shield 22 arranged to substantially surround the fiber winding spool 40. The whip shield 22 thereby contains the end of the fiber 42 within the whip shield 22 when the fiber 42 is cut or breaks and prevents damage caused by the end of the fiber 42 as it winds around the fiber winding spool 40 due to centrifugal force and forward motion and contacts the whip shield 22 and the whipping action of the fiber end on the wound fiber on the fiber winding spool 40. The whip shield 22 is illustrated in FIGS. 3-9 as a generally ring-shaped shield having an inner side and an outer side. The whip shield 22 includes a first surface 26 formed on the inner side of entry slot 24 which is facing the fiber winding spool 40. The first surface 26 is contained within the first elongated entry slot 24 provided within the inner side of the whip shield 22. The entry slot 24 surrounds first surface 26 which is aligned with the fiber 42 fed from the fiber entry feed mechanism 50 such that a loose end of the moving optical fiber 42 such as would occur during a fiber break event is directed into the entry slot 24 away from the fiber winding spool 40 due to centrifugal force and forward motion. The whip shield has a second surface 28 facing the spool 40. The second surface 28 is formed laterally offset from the first surface 26 in the inner surface of the whip shield 22. The second surface 28 has a depth of the slot which is less than the depth of the first surface 26 at the entry slot. The first surface 26 extends around the inner surface of the whip shield 22 and transitions in a helical shape to the second surface 28. The transition from first surface 26 to second surface 28 preferably occurs within one rotation of the fiber winding spool or 360 degrees of the whip shield 22. At the point where the first surface 26 transitions to the second surface 28, the depth of the first and second surfaces 26 and 28 are the same. Thus, the whip shield 22 is substantially circular or ring-shaped on the second surface 28 and the entry slot 24 forming the first surface 26 leading to the second surface 28 is substantially helical-shaped in the axial direction. As such, when the fiber 22 is cut or breaks, the loose end of the fiber 42 enters the entry slot 24 and is contained within the first surface 26 for about or less than one revolution of the spool 40 and the surrounding whip shield 22 and then transitions to the second surface 28 over a 360 degree rotation. The end of the fiber 42 then remains against second surface 28 until the fiber winding spool 40 is slowed down and stops.

The whip shield 22 is shown having an outer surface 30 extending around the outer perimeter of the whip shield 22, and a first side wall 32 and a second opposite side wall 34 defining the sides of the whip shield 22. The outer surface 30 has a transition surface 36 that is directed radially to connect the transition of the circumferences of the outer surface 30. The first surface 26 leading from the entry slot 24 through the transition to the second surface 28 preferably has a smooth surface that allows the end of the cut or broken fiber 42 to pass uninterrupted due to centrifugal force and forward motion so as to minimize any further whipping action or breakage of the fiber 42. Once the end of the fiber 42 passes through the entry slot 24 from the first surface 26 to the second surface 28, the end of the fiber 42 remains within the second surface 28. The second surface 28 preferably has a smooth contour that likewise does not cause any further breakage of the fiber 42 while the end of the fiber 42 rotates due to centrifugal force. In the embodiment shown, the second surface 28 is a cylindrical, uninterrupted channel having a circular cross section with a fixed radius and is continuously smooth without interruption such that the moving end of the fiber 42 passes smoothly along the second surface 28 until the fiber winding spool 40 stops rotating.

In the embodiment illustrated, the fiber entry whip reduction apparatus 10 may optionally include fiber entry feed mechanism 50. The fiber entry feed mechanism 50 may be operatively coupled to the whip shield 22 such that the fiber entry feed mechanism 50 and the whip shield 22 move in sync to feed the fiber onto the fiber winding spool 40 and shield the end of the fiber 42 when a break or cut occurs in a manner that reduces or prevents damage to the fiber 42. However, having a fiber entry feed mechanism such as is illustrated is not critical, and other methods of supplying the optical fiber can be provided, as is known in the art. The fiber entry feed mechanism 50 may be fixedly connected to the whip shield 22 so that the fiber 42 passes through the entry slot 24 when passing from the exit pulley 16 onto the fiber winding spool 40. According to one embodiment, the fiber winding spool 40 rotates to wind the fiber 42 onto the spool 40, but is fixed laterally such that it does not move laterally. The fiber entry feed mechanism 50 moves laterally across the length of the spool 40 to direct the fiber 42 evenly onto the fiber winding spool 40. In this embodiment, a motor or other actuator (not shown) may be employed to move the fiber entry feed mechanism 50 and whip shield 22 laterally back and forth together. According to another embodiment, the fiber entry feed mechanism 50 and whip shield 22 may be fixed in place and the fiber winding spool 40 may be actuated by another motor (not shown) to move laterally left and right in addition to rotating the spool.

Figure 3:
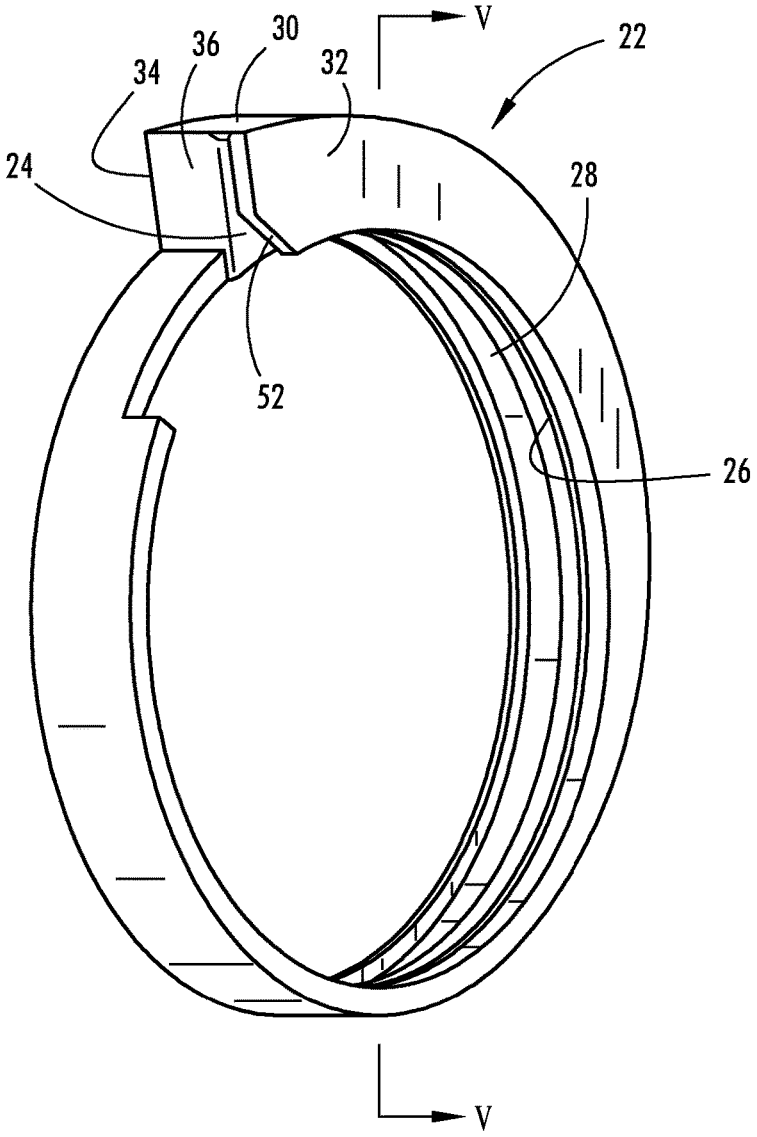
FIG. 3 is a front perspective view of the whip shield employed by the fiber entry whip reduction apparatus.
Figure 4:
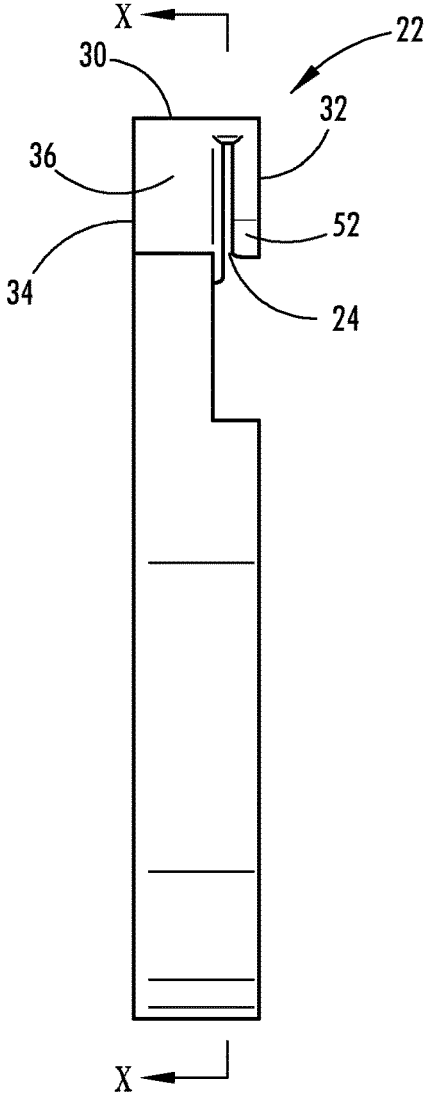
FIG. 4 is a front view of the whip shield shown in FIG. 3.
Figure 5:
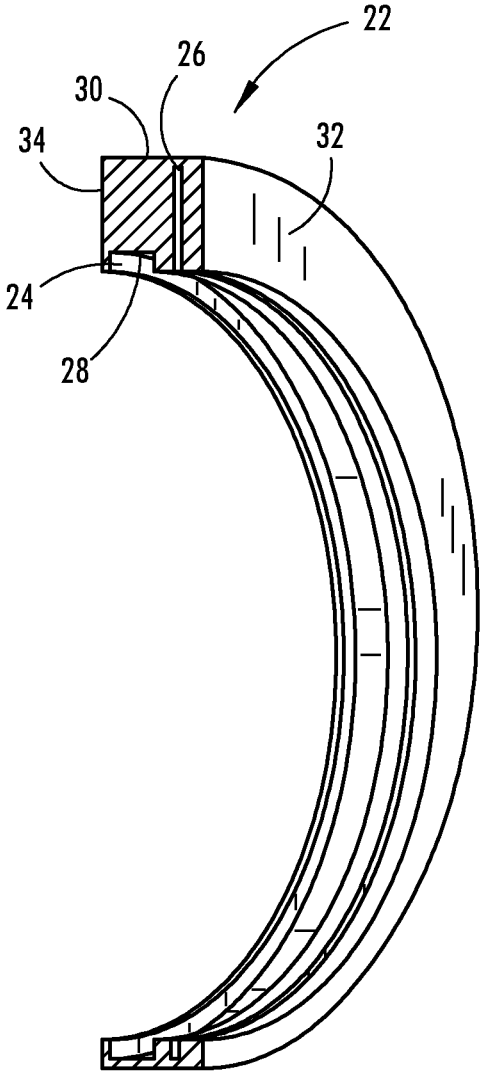
FIG. 5 is a perspective cross-sectional view taken through line V-V of FIG. 3 further illustrating the whip shield.
Figure 6:
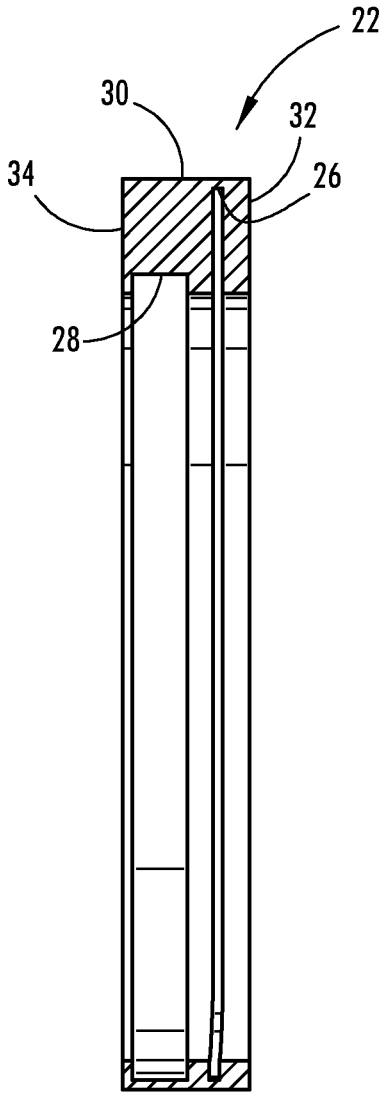
FIG. 6 is a cross-sectional view of the whip shield taken through line V-V of FIG. 3.
Figure 7:
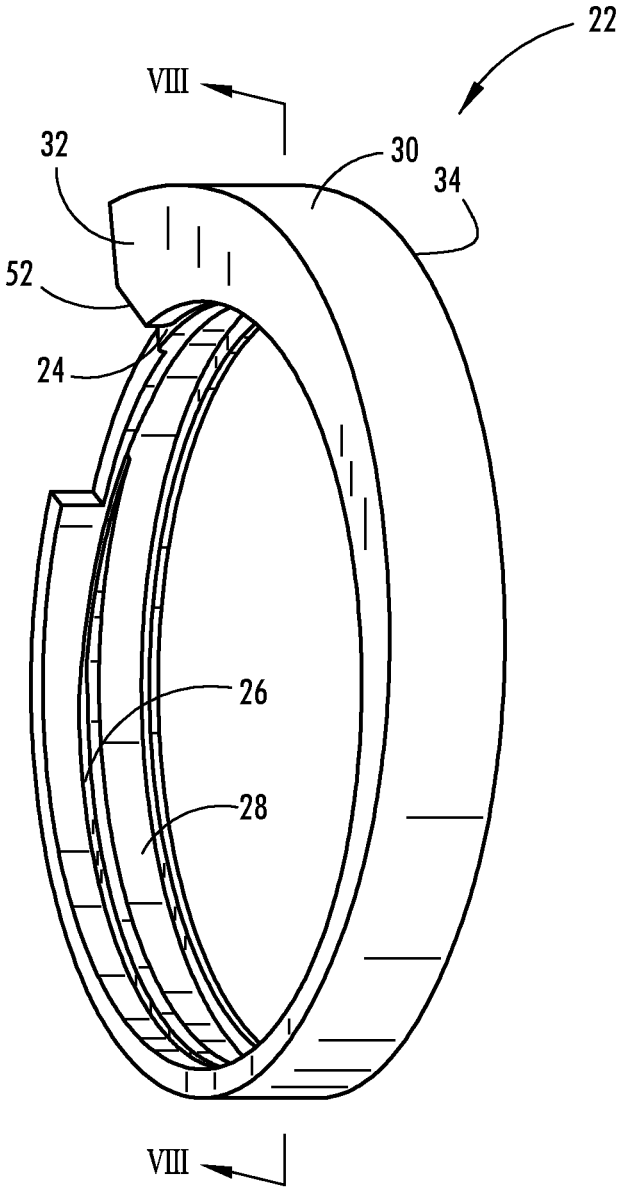
FIG. 7 is a rear perspective view of the whip shield shown in FIG. 3.
Figure 8:
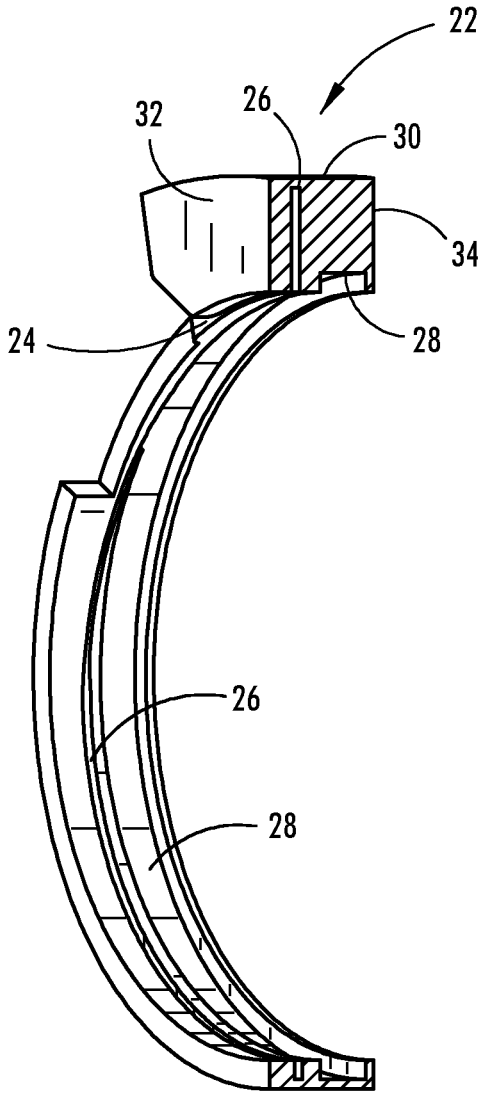
FIG. 8 is a perspective cross-sectional view of the whip shield taken through line VIII-VIII of FIG. 7.
Figure 9:
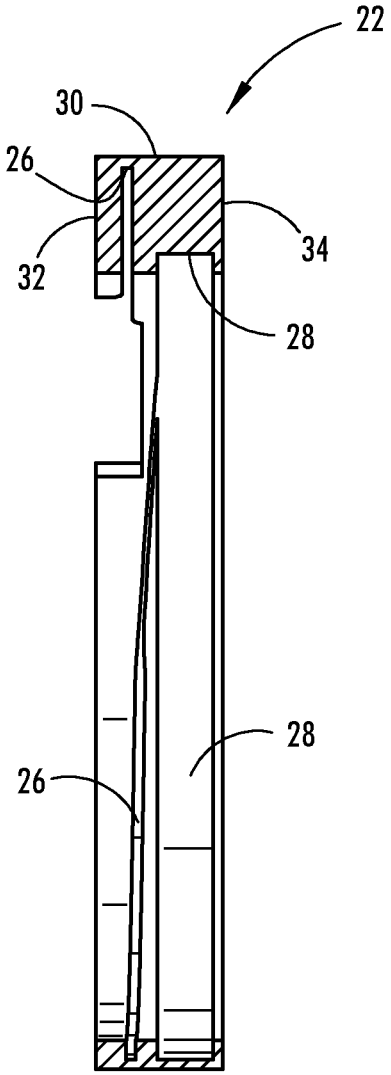
FIG. 9 is a cross-sectional view of the whip shield taken through line VIII-VIII of FIG. 7.

The side of the whip shield 22 at the entry slot 24 may include a fiber-line cut out portion 52 as seen in FIG. 3 which provides a way for the fiber 42 to be centered in the entry slot 24 while the fiber 42 is being wound on the fiber winding spool 42. Because of the fixed relationship and constant contact with the entry whip reducer 18, the whip shield 22 is maintained in a correct position to catch the free end of the fiber 42 when the fiber 42 breaks or is cut. The entry slot 24 is thereby in-line with the exit path of the entry whip reducer 18 and at the same approximate proximity and height to provide a smooth transition of the end of the fiber 42. Once the end of the fiber 42 moves forward inside the entry slot 24, rotational forces of the rotating fiber winding spool 40 keep the end of the fiber 42 pressed outward against the first surface 26 and away from the rotating fiber winding spool 40. The walls of the entry slot 24 extending throughout the first surface 26 as seen in FIGS. 5 and 6 contain the end of the fiber 42 and guide it in the intended direction. The side walls forming the entry slot 24 may be tapered or angled, according to one embodiment. In one embodiment, the first surface 26 of the entry slot 24 is profiled with a decreasing radius shape that gradually moves the end of the fiber 42 radially inward. For approximately the first half of rotation (i.e., 180°) through the first surface 26 of the entry slot 24, the shape of the entry slot 24 does not deviate axially as seen in FIGS. 5 and 6. For approximately the second half of rotation, the shape of the entry slot 24 spirals axially as shown in FIGS. 7-9 with a small degree of pitch until it transitions to the second surface 28. This guides the end of the fiber 42 towards the cylindrically shaped second surface 28 of the whip shield 22 where it remains until the spool 40 stops rotating. The end of the fiber 42 is held in the cylindrical second surface 28 using rotational forces and the channel walls that help prevent lateral movement of the fiber 42. The entry whip reducer 18 stops traversing almost immediately when a cut or break is detected and the whip shield 22 is positioned almost directly over where the end of the fiber 42 meets the fiber winding spool 40. This position means that the fiber end would only have a very small amount of lateral deflection between the fiber tip and its position on the spool 40. The low lateral deflection, the stiffness of the fiber, the high rotational forces, the width of the cylindrical and the channel walls keep the fiber tip in the cylindrical second surface 28 until the spool stops rotating.

While spinning in the cylinder, there are no radial gaps across or over which the fiber 42 has to pass. The smooth second surface 28 of the whip shield 22, the hard, protective coating of the fiber 42 and the lack of any gaps creates an environment which allows the fiber 42 to rotate in the cylinder while preventing any sharp reduction which could lead to whip damage on the upper layers of the fiber pack and spool 40.

While the fiber winding spool 40 is slowing to a stop, the entry whip reducer 18 may lift away from the whip shield 22 to allow for unloading of the fiber winding spool 40 and loading of a new empty fiber winding spool 40. Because the entry whip reducer 18 is positioned adjacent to the cylindrical channel of the first surface 26 and does not form part of it, the whip reducer 18 can lift away without disrupting the end of the rotating fiber 42. However, the whip shield 22 should stay in position so its traverse power is deactivated and a brake, attached to a rail on which the whip shield 22 moves, may be engaged. The whip shield 22 may remain in this position until the fiber winding spool 40 stops rotating and there is no potential for damage from the fiber tip hitting the spool 40 or creating shards. When the fiber winding spool 40 is ready to be removed, the brake may be disengaged, the traverse power may be activated, and the whip shield 22 slides beyond a flange of the spool 40. Once a new spool 40 is loaded, and an automatic clean-out sequence with compressed air is completed, the whip shield 22 is ready to begin operation when needed to wind fiber onto the new fiber winding spool 40.

Figure 10:
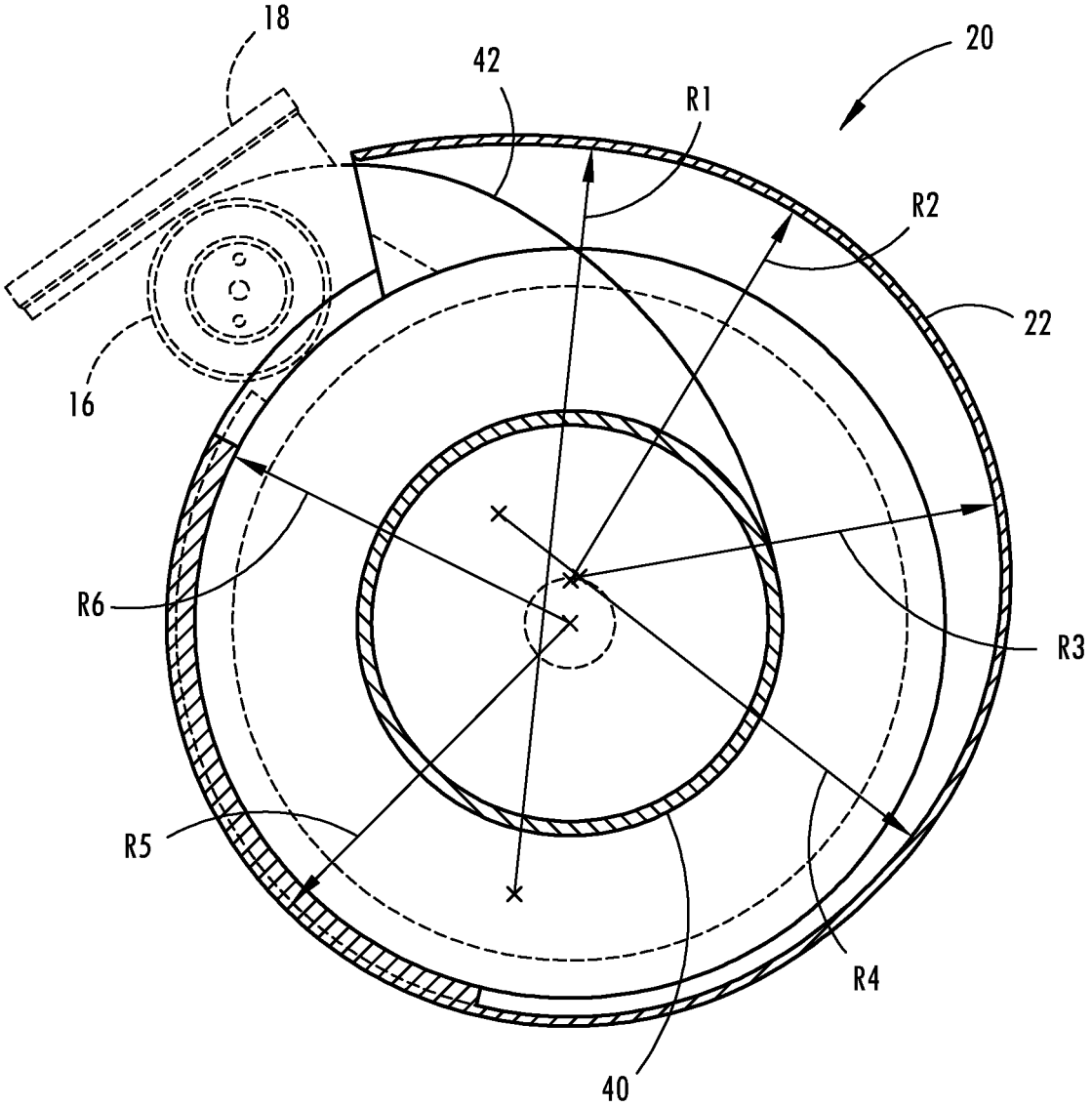
FIG. 10 is a cross-sectional view taken through line X-X of FIG. 4 further illustrating the fiber entry whip reduction apparatus.

Referring to FIG. 10, the fiber entry whip reduction apparatus 10 is further illustrated showing the shape of the entry slot 24 and its first surface 26 as it transitions towards the second surface 28. The first surface 26 of the entry slot 24 has a curved shape with varying radii that change between the entrance to the entry slot 24 and the transition to the second surface 28. The various radii of the first surface 26 are illustrated by radii R1-R5. Radius R1 is larger than the next successive radius R2 and each of the following successive radii R3-R5 along increasing angular positions of the whip shield 22. As such, the first surface 26 transitions from the larger radius to a smaller radius as the fiber 42 proceeds from the entrance to the second surface 28. In addition, the fixed radius R6 of the second surface 28 is shown. The second surface 28 has a uniform radius R6 to provide a continuous smooth surface. This provides for further enhanced reduction whip of the fiber 42.

In operation, when the fiber 42 is being wound onto the fiber winding spool 40 and when the fiber 42 is cut or breaks, the terminal end of the fiber 42 passes through the fiber entry feed mechanism 50 provided by pulleys 12, 14 and 16 and entry whip reducer 18. In the embodiment of entry whip reducer 18 which is illustrated, fiber whip is minimized as the end of the fiber 42 passes over exit pulley 16 by constructing the angle of the inner surface of the entry whip reducer 18 to be aligned with first surface 26 so that the end of the fiber 42 will then continue to enter and move outward within the entry slot 24. In this way, when a fiber break occurs, due to centrifugal force of the fiber traveling around exit pulley 16, the fiber is first forced against the curved surface of fiber whip reducer 18 which is aligned with first surface 26, so that the fiber is guided by curved surface of fiber whip reducer 18 to contact and push against the first surface 26 and pass along the first surface 26 throughout a complete transition of approximately 360 degrees where it then transitions to and enters the second surface 28. The second surface 28 thereby smoothly controls the terminal end of the fiber 42 and isolates it from the remainder of the fiber 42 such that damage to the fiber 42 wound on the fiber winding spool 40 is prevented or minimized. Once the end of the fiber 42 passes onto the second surface 28 of the whip shield 22, the terminal end of the fiber 42 will continue to smoothly rotate in a circular path uninterrupted until the fiber winding spool 40 comes to a substantially complete stop.

Accordingly, the fiber entry whip reduction apparatus 10 advantageously controls the whipping action of the cut or broken fiber 42 so as to minimize damage to the fiber 42 as the fiber end passes along the inside surface of the whip shield 22. The novel whip shield 22 thereby prevents further breakage of the terminal end of the fiber 42 and shards which may cause further damage to the fiber 42 wound on the fiber winding spool 40.

The described embodiments are preferred and/or illustrated, but are not limiting. Various modifications are considered within the purview and scope of the appended claims.

What is claimed is:

1. An apparatus for reducing fiber whip damage to optical fiber wound on a fiber winding spool, comprising:

a whip shield arranged to substantially surround the fiber winding spool, the whip shield comprising a first surface aligned with and facing the fiber winding spool within an entry slot aligned with the fiber fed from a moving source of fiber such that a loose end of the optical fiber during a fiber break event is directed into the entry slot away from the fiber winding spool and against the first surface;

the whip shield comprising a second surface facing the spool, wherein the first surface of the entry slot transitions to the second surface so that the loose end of the optical fiber is transitioned from the first surface onto the second surface, wherein the first surface retained within the entry slot has a curved shape with varying radii and the second surface has a substantially uniform radius.

2. The apparatus of claim 1, wherein the entry slot is laterally offset from the second surface.

3. The apparatus of claim 1, wherein the entry slot transitions from the first surface to the second surface within one rotation of the fiber winding spool.

4. The apparatus of claim 1, wherein the second surface of the whip shield is substantially ring-shaped, and wherein the entry slot is substantially helical-shaped.

5. The apparatus of claim 1, wherein the apparatus further comprises a fiber entry feed mechanism operatively coupled to the fiber winding spool to feed the optical fiber onto the fiber winding spool.

6. The apparatus of claim 5, wherein the fiber entry feed mechanism comprises a fiber entry whip reducer.

7. The apparatus of claim 5, wherein the fiber entry feed mechanism comprises at least one exit pulley.

8. A method for reducing fiber whip damage to fiber wound on a fiber winding spool, the method comprising the steps of:

feeding optical fiber from an optical fiber source onto the fiber winding spool;

directing a loose end of the fiber into an entry slot formed having an inner first surface in a whip shield; and redirecting the loose end of the fiber from the entry slot to a smooth continuos second surface on an inner surface of the whip shield, wherein the first surface of the entry slot has a curved shape with varying radii and the second surface has a substantially uniform radius.

9. The method of claim 8, wherein the first surface of the entry slot transitions to the second surface so that the loose end of the optical fiber is directed through the entry slot and onto the second surface.

10. The method of claim 9, wherein the entry slot transitions from the first surface to the second surface within one rotation of the fiber winding spool.

11. The method of claim 8, wherein the second surface of the whip shield is substantially ring-shaped, and wherein the entry slot is substantially helical-shaped.

12. The method of claim 8, wherein the step of feeding comprises feeding the optical fiber from the optical fiber source through a fiber entry feed mechanism and onto the fiber winding spool.

13. The method of claim 12, wherein the fiber entry feed mechanism comprises a fiber entry whip reducer comprising a curved surface which is positioned to align with and transfer the loose broken fiber end onto the inner first surface.

14. The method of claim 12, wherein the fiber entry feed mechanism comprises at least one exit pulley.

15. The method of claim 8, wherein the entry slot is laterally offset from the second surface.

* * * * *